US006513525B2

(12) United States Patent
Chen

(10) Patent No.: US 6,513,525 B2
(45) Date of Patent: Feb. 4, 2003

(54) TRIPLICATE DIVING GAS VALVE DEVICE

(76) Inventor: Frankie Chen, 4F, No. 20, Ln. 46, Shin-Tung Rd., Taipei (TW)

( * ) Notice: Subject to any disclaimer, the term of this patent is extended or adjusted under 35 U.S.C. 154(b) by 0 days.

(21) Appl. No.: 09/734,899

(22) Filed: Dec. 13, 2000

(65) Prior Publication Data

US 2002/0157669 A1 Oct. 31, 2002

(51) Int. Cl.[7] ..... A61M 16/00
(52) U.S. Cl. ..... 128/204.26; 128/201.28
(58) Field of Search ..... 128/204.26, 200.24, 128/200.29, 201.19, 201.26, 201.27, 201.28, 205.24; 405/186, 187; 116/27; 441/89, 96; 367/142

(56) References Cited

U.S. PATENT DOCUMENTS 4,269,386 A * 5/1981 Crowe ..... 182/48
4,852,510 A * 8/1989 Joseph et al. ..... 116/137 R
4,998,499 A * 3/1991 Norbeck ..... 116/137 R
5,092,325 A * 3/1992 Ainscough ..... 128/201.27
5,127,398 A * 7/1992 Stone ..... 128/204.18
5,302,055 A * 4/1994 Johnston ..... 116/112
5,343,858 A * 9/1994 Winefordner et al. . 128/204.26
5,471,976 A * 12/1995 Smith ..... 128/201.27
5,503,142 A * 4/1996 Semeia ..... 128/201.28
5,520,485 A * 5/1996 Hermansen ..... 405/186
5,605,145 A * 2/1997 Hannah et al. ..... 128/201.19
5,724,961 A * 3/1998 Tistrand ..... 128/200.29
5,788,415 A * 8/1998 Chen ..... 128/201.28
5,829,431 A * 11/1998 Hannah et al. ..... 128/201.19
RE36,223 E * 6/1999 Schuler ..... 128/205.24
5,921,832 A * 7/1999 Thiermann ..... 441/41
5,944,054 A * 8/1999 Saieva ..... 128/201.28
5,951,205 A * 9/1999 Chen ..... 116/27
6,039,043 A * 3/2000 Graber et al. ..... 128/202.14
6,055,981 A * 5/2000 Laswick et al. ..... 128/204.18
6,227,199 B1 * 5/2001 Garofalo ..... 128/204.26
6,279,575 B1 * 8/2001 Belloni ..... 128/204.26
6,332,464 B1 * 12/2001 Chen ..... 128/201.19

* cited by examiner

*Primary Examiner*—Aaron J. Lewis
*Assistant Examiner*—Teena Mitchell
(74) *Attorney, Agent, or Firm*—Troxell Law Office PLLC

(57) ABSTRACT

Triplicate Diving Gas Valve Device, comprising: a siren unit, a Life Coat Inflation unit and a User's Respiration Unit. The Siren drives its alarm sounding by reciprocating pounding of piston in a cylinder, by reason of this, the siren will serve its purpose ready submerged in waters or on the surface. The Gas Valve can be used in combination with both the Life Coat and the Respiration Mouthpiece, it can be manipulated manually using one hand expeditiously for triplicate services including: Life Coat Inflation/Deflation, siren alarming appealing for Help, and Respiration-charged air-compression. At a suitable location in the Respiration Mouthpiece is positioned a Flow Division Block serving to block compressed gas that is supplied from the Compression Cylinder, so that the compressed gas is split to pass to flanks on both sides, in that manner safeguarded from charging straight into Diver's throat, so that the diver is relieved from any discomfort while breathing all the while.

4 Claims, 11 Drawing Sheets

TRIPLICATE DIVING GAS VALVE DEVICE

FIELD OF THE INVENTION

This invention relates a triplicate Diving Gas Valve Device, more particularly it relates to one triplicate Gas Valve Assembly which is to be used in conjunction with a Compression Cylinder for a three-in-one purpose including: siren alarming, Life Coat inflation and facilitating User Diver's Respiration.

BACKGROUND OF THE INVENTION

Among the paraphernalia which a diver equips himself for a diving operation, nowadays or earlier, the Compression Cylinder is used to contain compressed air which is be released by way of a Breathing Mouthpiece to keep the diver respiring as usual while diving underwaters. Additionally, the same Compression Cylinder is associated with a Buoyancy Compensator Jacket, to be termed Life Coat for short herein by means of an air hose which incorporates charge valves and discharge valves to control the charging or discharging of air so as to adjust the buoyancy of the Life Coat when the diver is physically submerged underwaters.

There is another equipment indispensable for a diver ready to go for diving activities, and that is the alarm device serving to release vocal signals appealing for help in case of emergency. In a conventional design, the alarm device owes its intended signalling sounds to the vibration occasioned by a pressure differential which occurs repeatedly on both sides of a diaphragm because of compressed air supplied by the Compression Cylinder, whereupon the appeal for help is served. Regrettably, however, it is a pity to realize that such a diaphragm vibration mode of actuation which depends on a change in air compression will be defeated completely once the diver dives underwaters because the water, marine or riverine, will then seep into the diaphragm or speaker, rendering the alarm device totally inoperative. So in fact and indeed, an alarm device as such is good for use on the surface only, and it will be good for nothing in so far as underwater activities are concerned. So the reasoning becomes that, should anything happen to a diver while pursuing diving activities underwaters, such as, for example, body failure, or diver's professional disease, or discomfort due to want of oxygen, or even sudden attack by the shark, he would not be able to keep fellow divers timely informed around, and the diver in question would face impending danger with his life at risk, all that suffices to pointing to present insufficiency with existent conventional diver's alarming facilities which warrant immediate improvements the sooner the better.

One notes with no less regret to see that almost all the diver's air valve supplies of conventional design available on the marketplace feature but one, but never all of the triplicate functions as aforementioned, namely, alarming siren, inflation of Life Coat and facilitation to diver's respiration while active underwaters, the best to expect is to see two of such triplicate functions realized on a single Air Valve Assembly, but again, never all the indispensable features combined in any one single Air Valve Assembly, let alone being light-weighthed, and compatibility for single hand operation at the same time, such that in practice, with a conventional design, owing to the want of a suitable gas conduit means on the air valve, at least two air hoses must be interconnected with the compression cylinder to run respectively to gas valves bearing different functions, and that means lots of inconveninece for operation, besides, with such design, the diver will have to spend extra money to buy different gas valve units, from which a need for improvement is felt automatically.

More to mention, with a conventional design respiratory mouthpiece, due to want of a suitable shunt, that is, bypass means, compressed gas supplied from the Compression Cylinder can very often rush straight into diver's throat, resulting in much discomfort to the diver while breathing, and that is also a shortcoming justifying immediate correction.

In view of all the drawbacks and shortcoming enumerated in the foregoing, all associated with prior arts, the inventor has been betaking himself to working for improvement backed with several decades of experience accumulated in the production of all sorts of diving equipments as well as practicing of academical principles, and who has finally come out with the, present invention which eliminates all at once all of the aforementioned shortcomings known in the art, up to this day.

SUMMARY OF THE INVENTION

Accordingly, the primary object of the invention is to provide a Triplicate Diving Gas Valve Device featuring triplicate Alarming Siren, Life Coat Inflation and Facilitation to Diver's Breathing purpose and that achieved in a manner more convenient, cost efficient than any prior art.

A further object of the invention is to provide such a Triplicate Diving Gas Valve Device in respect of which the Alarming Siren sub-assembly is good for operation both underwaters and on the surface, more specifically, said Siren will effectively release acoustic warning signals while the diver equiped accordingly is engaged in activities underwaters so that the warning signal may reach other people around in time, highlighted in structural simplicity, compact volume facilitating ease of carriage and ease of use, the subject Triplicate Diving Gas Valve Device may be used in conjunction with Compression Cylinder, Life Coat and Respiratory Mouthpiece, manipulated using one hand to serve the purpose of Life Coat Inflation, Deflation, Transmission of the Alarming Siren to appeal for Help, as well as breathing by means of compressed air supply, it is so delicately structured that exposed in a water setting the frictional resistance may be kept to the minimum, other advantages realisable with the invention include lowered production and installation costs.

A further object of the invention is to provide such a Triplicate Diving Gas Valve Device which incorporates a shunting block at a suitable location on the Respiratory Mouthpiece as a part thereof, serving to block the incoming supply of compressed air flow so that the flow will pass to the flank on both sides instead, restrained from plunging straight into Diver's throat, so that while breathing underwaters the Diver will not feel ill at ease at all.

To achieve any and all of the purposes set forth in the foregoing, the subject Triplicate Diving Gas Valve Device is recommended for use together with a Compression Cylinder to best serve the alarming Siren Warning, Life Coat Inflation and Facilitation of Diver's underwater Breathing purposes, structurally the invention Triplicate Diving Gas Valve Device comprises:

Body which is furnished with a number of orifices each being selectively linked within so that a plurality of inter related, insulated, isolated spaces are formed within, on one side of the Body is disposed a blocking film which is applied to cover up the first orifice, also a first locking & Fastening means which is coupled to said blocking film and to be locked, secured to the first orifice side on the Body, and a third orifice which is accessed eventually to the Life Coat;

A shunting means housed in the Body and furnished way between the first orifice and the second orifice, which shunt means further incorporates an intake coupling of which the interior is in the form of a hollow-set gas conduit extending axially, to an internal end of the intake coupling is licked a hollow-set big sleeving by means of a hollow-set binder, into the big sleeving is seated a screw capable of effecting linear glides therein, to one end of said screw is attached a minor sleeving, symmetrical with respecting to the binder, to the same screw is mounted a first spring whose resetting resiliency suffices to bring the minor sleeving tight-sealed to said binder free of external stress, a sway arm has one elbow attached to the screw, another elbow in contact with said blocking film, on one end of the intake coupling is fitting an intake means projecting outside the second orifice and accommodating the Compression Cylinder, additionally, on the surface outside the intake coupling are furnished a number of grooves isolated from each other by a plurality of o-ring hermetically by the provision to have both the first air intake and the second air intake installed radially to the intake couple, the conduits inside the intake coupling may be selectively conducted to the first groove and the second groove on the external surface, with the first groove being accessible to the third orifice;

A Siren Unit, mounted in a sixth orifice of the Body, which unit consists of: a hollow-set cylinder, a hollow-set piston penetrating across the Cylinder and a pounding member installed on one end of the Cylinder, the piston being available for reciprocating movements in the Cylinder so that the pounding member on being collided by the piston in motion will release an alarming siren at once, the hollow-set piston being pneumatically communicated to the second groove on the surface outside the intake coupling;

A Respiratory Mouthpiece, coupled to a ninth orifice on the Body, and in communication with the space inside said blocking film, such that as the user diver betakes himself to breath through the Respiratory Mouthpiece, the blicking film will shrink inwardly due to a pressure drop which takes place in the space within, which in turn compels the sway arm to pull both the screw and the minor sleeving apart from the binder so that the air-tight-sealing condition is defeated, to follow that, gas resident in the Compression Cylinder will flow into the space inside the blocking film by way of gas conduit, and that accounting for air supply fed to the diver who respires on it through the Respiratory Mouthpiece;

Siren Button, furnished on an eighth orifice on the Body, and that in common transmission with said first air intake, the first air intake will be driven open when the Siren Button is pressed, whereupon gas inside the Compression Cylinder will flow to the second groove on the surface outside the intake coupling by way of the gas conduit and the first air intake, next onto the Siren Unit so that the piston is driven to reciprocating movement in the Cylinder concurrent with the release of warning alarm;

A Charge Button, furnished on a fourth orifice of the Body and functionally in common with the second air intake, when pressed will drive the second air intake open so that gas stored in the Compression Cylinder flows to the first groove on the surface outside the intake coupling by way of Gas Conduit and the Second air intake before arriving eventually at the third orifice to inflate the Life Coat; and an array of discharge/blow switching unit, furnished way between a seventh orifice and a fifth orifice of the Body, and in association with the space inside said blocking film, said unit further comprising:

a check valve means, furnished in said seventh orifice which further incorporates: a flow insulation ring having a number of holes provided thereon, a film covering one side of the floe insulation ring to form a check valve, a pushbutton mounted in the seventh orifice and accommodating said film and the flow insulation ring, plus a second spring mounted also in the seventh orifice, and bearing against the pushbutton so as to produce a resetting tension whereby the pushbutton is compelled to project off the seventh orifice in the absent of any applied stress, on the surface of side of the pushbutton are provided a number of holes accessible to atmospheric setting so long as the pushbutton remains projected off the seventh orifice, but is instead sealed by the Body once compelled into the seventh orifice; and, a switching means, furnished in the fifth orifice and comprising: a follower of which one end is linked to and coacting with said flow insulation ring, a second air-tight cork which is attached to the other end of the follower, plus a fastening harness which is pneumatically concealed under the fifth orifice and houses both the follower and the second air-tight cork;

structured accordingly, for so long as the pushbutton remains projected off the seventh orifice, the second air-tight cork is pneumatically applied to be covering up an interior hole inside the fifth orifice, whereupon the third orifice remains in a state other than in communication with the space inside the blocking film, so that exhalation from the diver user by way of the Mouthpiece may find its way to the atmosphere through the space inside the blocking film, the check valve means, and eventually by way of the orifice on the lateral surface of the pushbutton.

Once the pushbutton is pressed into the seventh orifice, the second air-tight cork is brought apart from said interior hole to bring the third orifice in pneumatical communication with the space inside the blocking film, so that exhalation from the user diver by way of the Respiratory Mouthpiece may proceed by way of the space inside the blocking film and the third orifice, into the Life Coat and inflation begins.

In a preferred realization, the Respiratory Mouthpiece further incorporates a shunt block positioned just as an obstacle in the gas flow course whereby compressed air oncoming from the Compression Cylinder is shunted to bypass bilaterally, and in that manner prevented from charging straight into user's throat.

In still another preferred realization, the Siren Unit further incorporates current guide shoe interposed way between the Gas Cylinder and the Pounding Member. On that side of the current guide shoe which faces the Cylinder are furnished a plurality of axially extending conduit grooves, on the surface of the exteriority of that part of the piston that is close to the pounding member are provided by penetration radial gas holes which are in communication with area inside the Gas Cylinder way off to the external surface of the piston; so that once the user presses the Siren Button while the piston is instantly distant enough from the pounding member, that end of the piston which is represented by a greater diameter will, by the thrust coming from the compressed air flow, bring the piston pushed to the pounding member, until the piston comes into contacting with the pounding member, the axial gas hole of the piston is aligned just to the conduit groove of the current guide shoe, and the head portion of the piston to abut upon and therefore sealing the axial gas hole of the Gas Cylinder, to the effect that gas pressure inside the Cylinder is directed via the gas conduit groove to the atmosphere, and pressure is downgraded, at this juncture the pressure prevailing inside the Cylinder and on the external surface of the piston will exceed pressure prevalent about the head portion of the piston, such that the piston is eventually thrusted off the pounding member, and that effect placing the piston in recycled reciprocating movement in the Cylinder, concurrent with the release of alarming siren signal.

DETAILED DESCRIPTION OF THE PREFERRED EMBODIMENT

Overall, the top feature of the present invention, titled Triplicate Diving Gas Valve Device, lies in a three-in-one alarm siren unit, Life Coat Inflation Unit and User's Respiration Facilitation composite structure on a single Gas Valve Assembly meant for operation together with a Compression Cylinder. The Siren Unit derives its warning sound by having the piston to impinge upon a pounding member reciprocatingly in the Cylinder, so it is good for operation underwaters as well as on the surface, more specifically a diver who is engaged in underwater activities may produce the warning sound for intensional purposes anytime he feels a need for that, simply structured, compact and light-weight, it is convenient for handy carriage and for use too. The subject Gas Valve Assembly is good for use in combination with a Life Coat or/and a Respiratory Mouthpiece, operation may be run single-handedly, convenient as ever, to inflate the Life Coat, that is, Buoyancy Compensation jacket, to deflate same, to release alarming siren in an effect to appeal for help, in case of need, and to compress airflow by diver's exhalation, such triplicate functions being achievable with minimum frictional resistance in underwater circumstances so that costs in production as well as installation may be cut to the minimum levels. An additional advantage of the invention Triplicate Diving Gas Valve Device lies in the provision of a shunt block on a suitable position of the Respiratory Mouthpiece, serving to bypass the flow of compressed air supplied from the Compression Cylinder bilaterally so that the flow will not rush straight into diver's throat, and the diver is relieved from discomfort who breathing underwaters.

Figure 1:
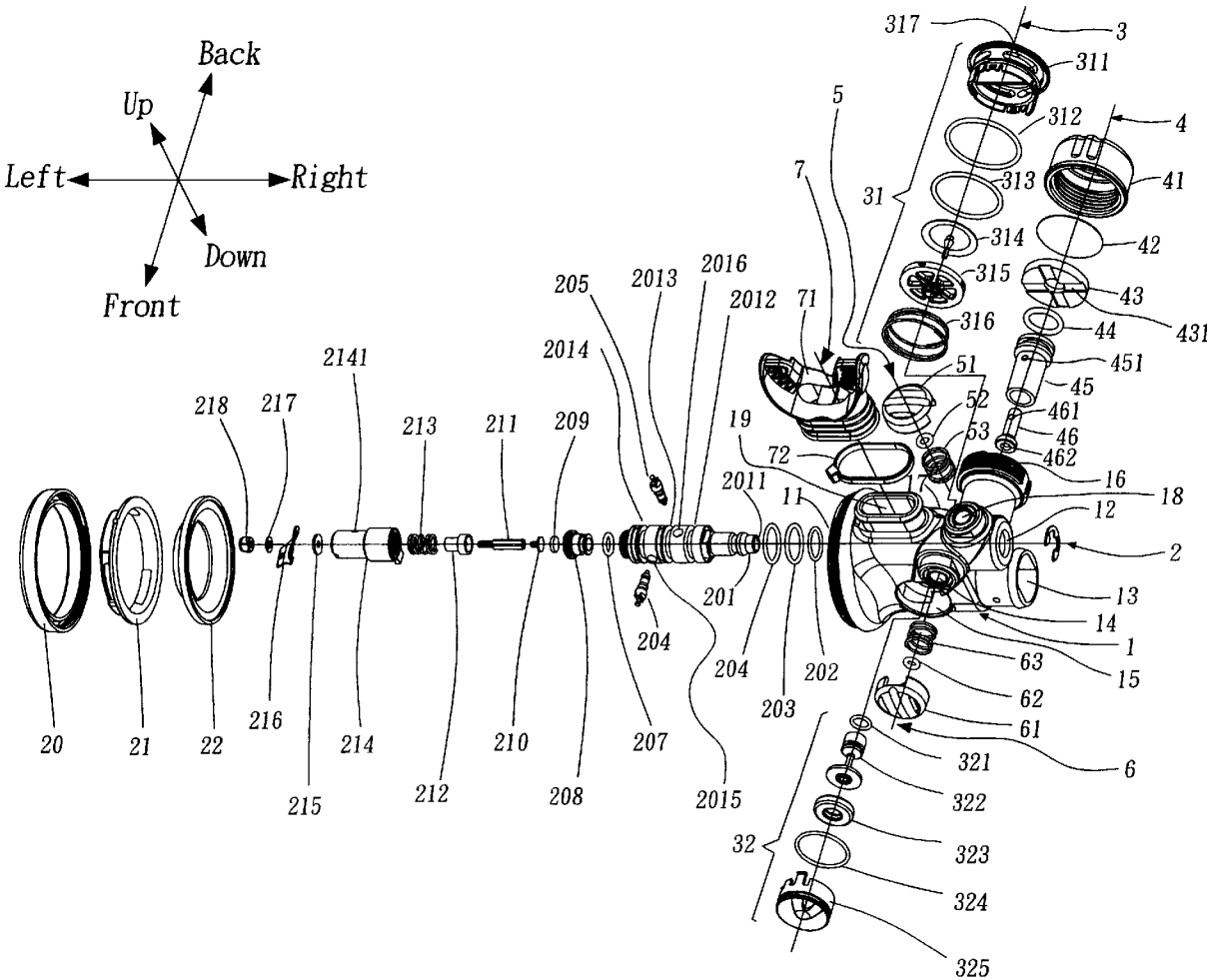
FIG. 1 is a three-dimensional exploded view of the invention Triplicate Diving Gas Valve Device.
Figure 2A:
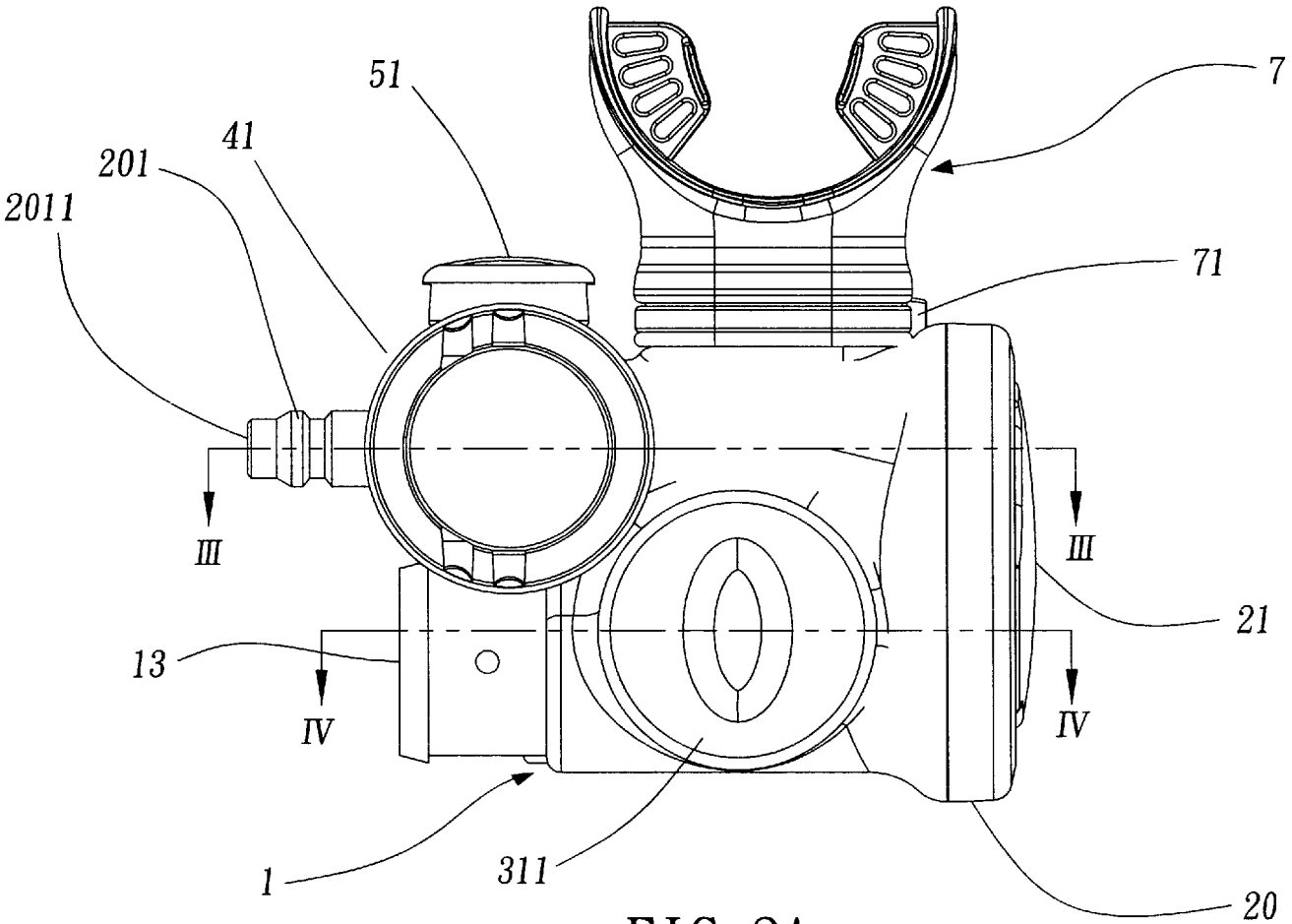
FIG. 2A is a rear view of a plane layout of the invention Triplicate Diving Gas Valve Device.
Figure 2B:
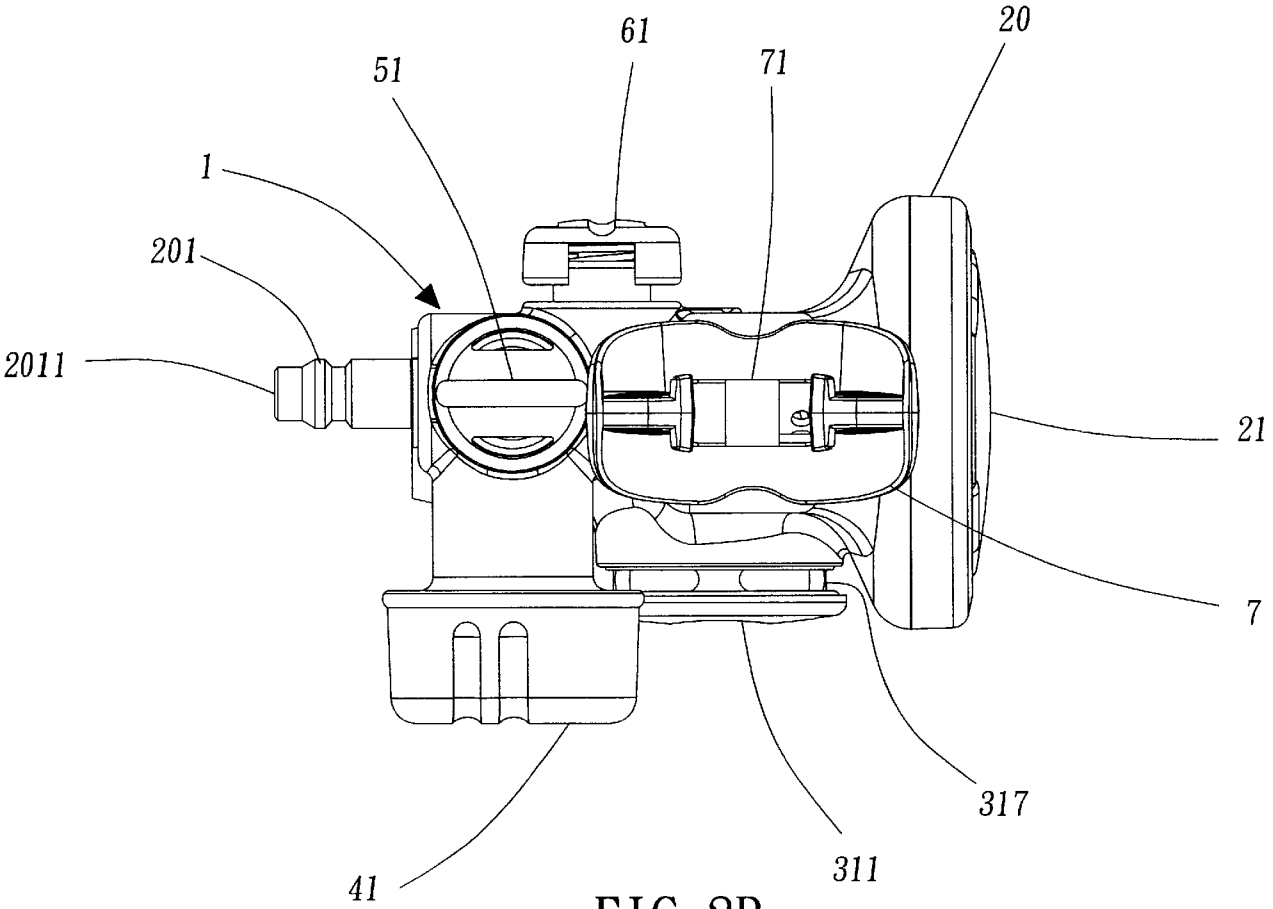
FIG. 2B is a top view of a plane layout of the invention Triplicate Diving Gas Valve Device.
Figure 2C:
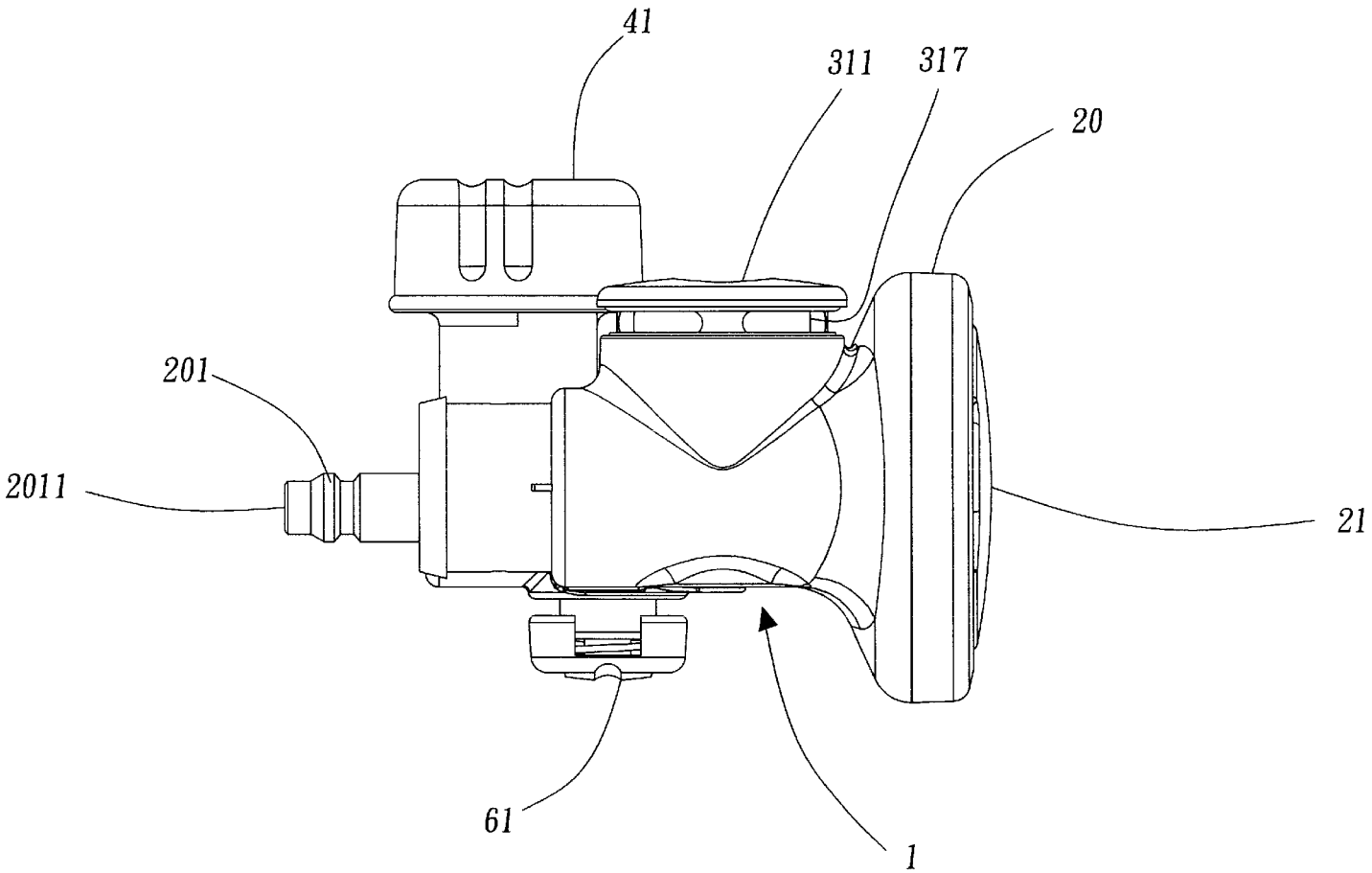
FIG. 2C is a bottom view of a plane layout of the invention Triplicate Diving Gas Valve Device.
Figure 2D:
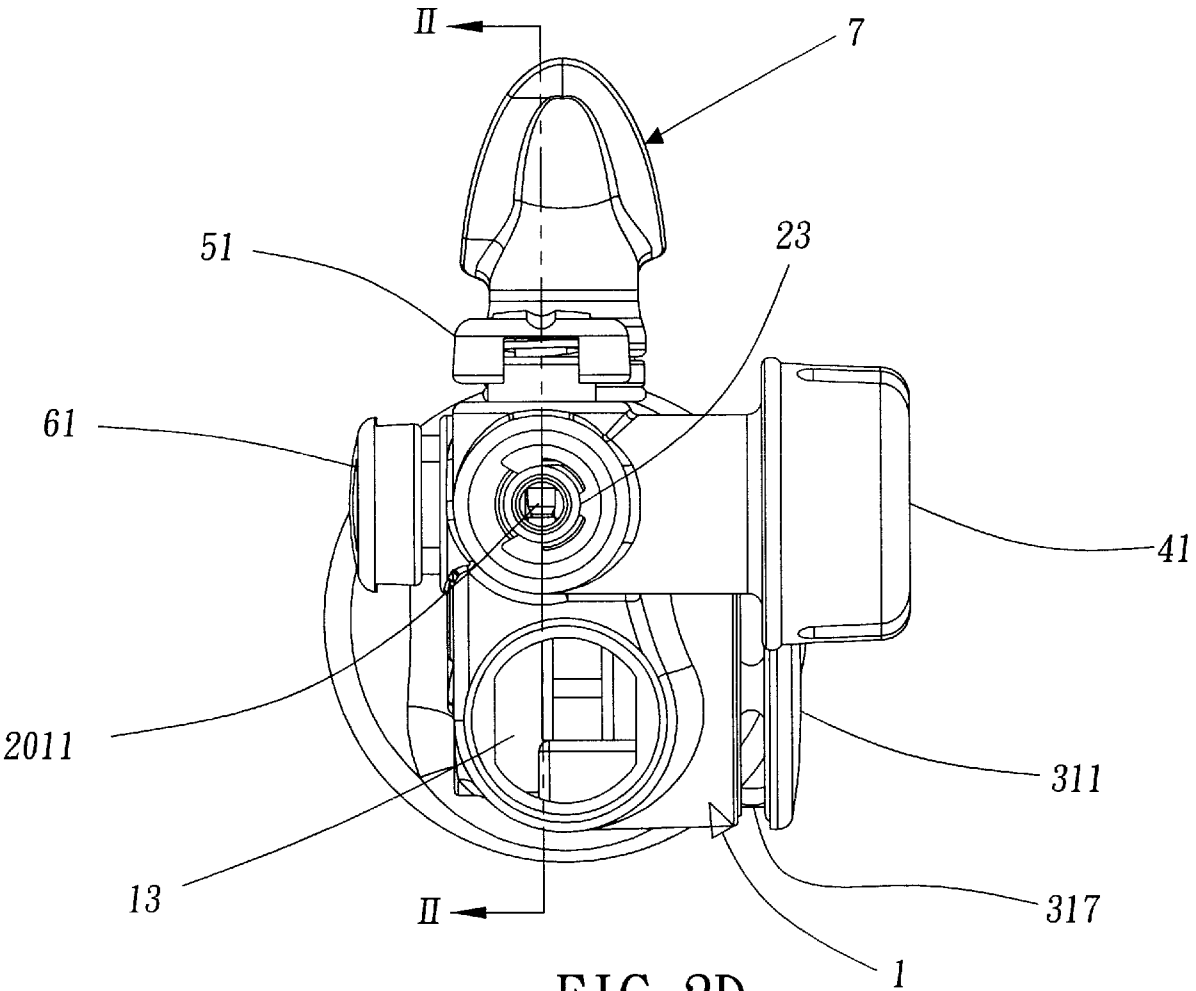
FIG. 2D is a right side view of a plane layout of the invention Triplicate Diving Gas Valve Device.
Figure 2E:
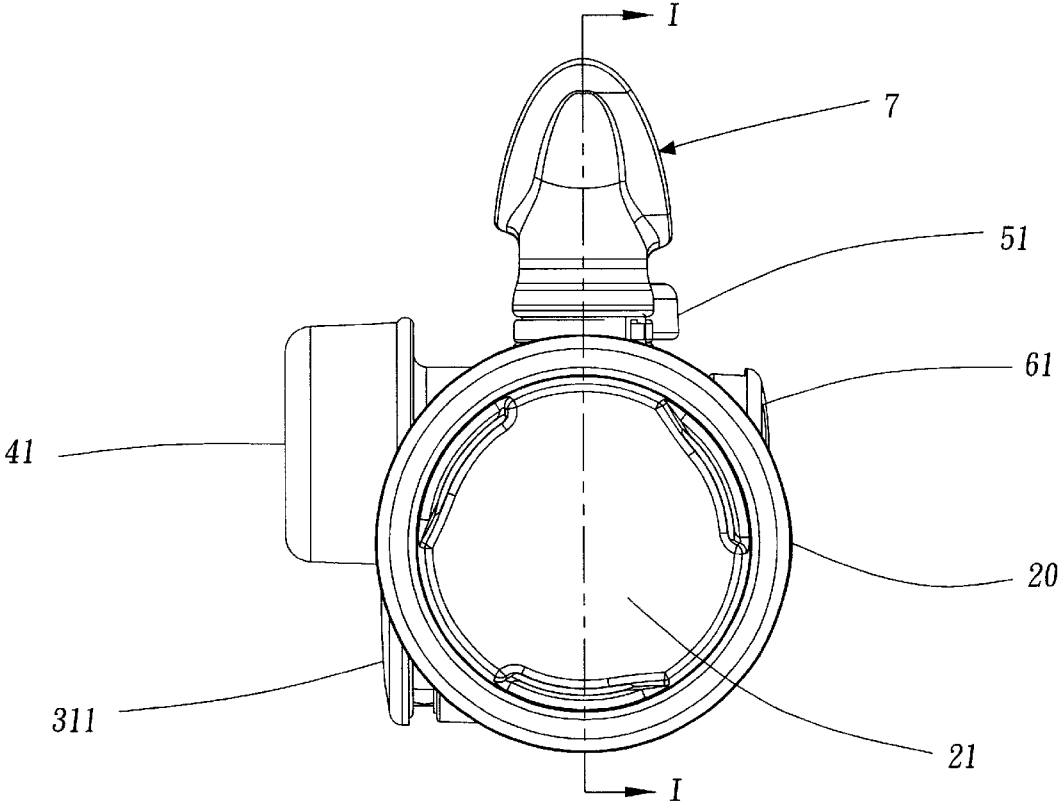
FIG. 2E is a left side view of a plane layout of the invention Triplicate Diving Gas Valve Device.
Figure 2F:
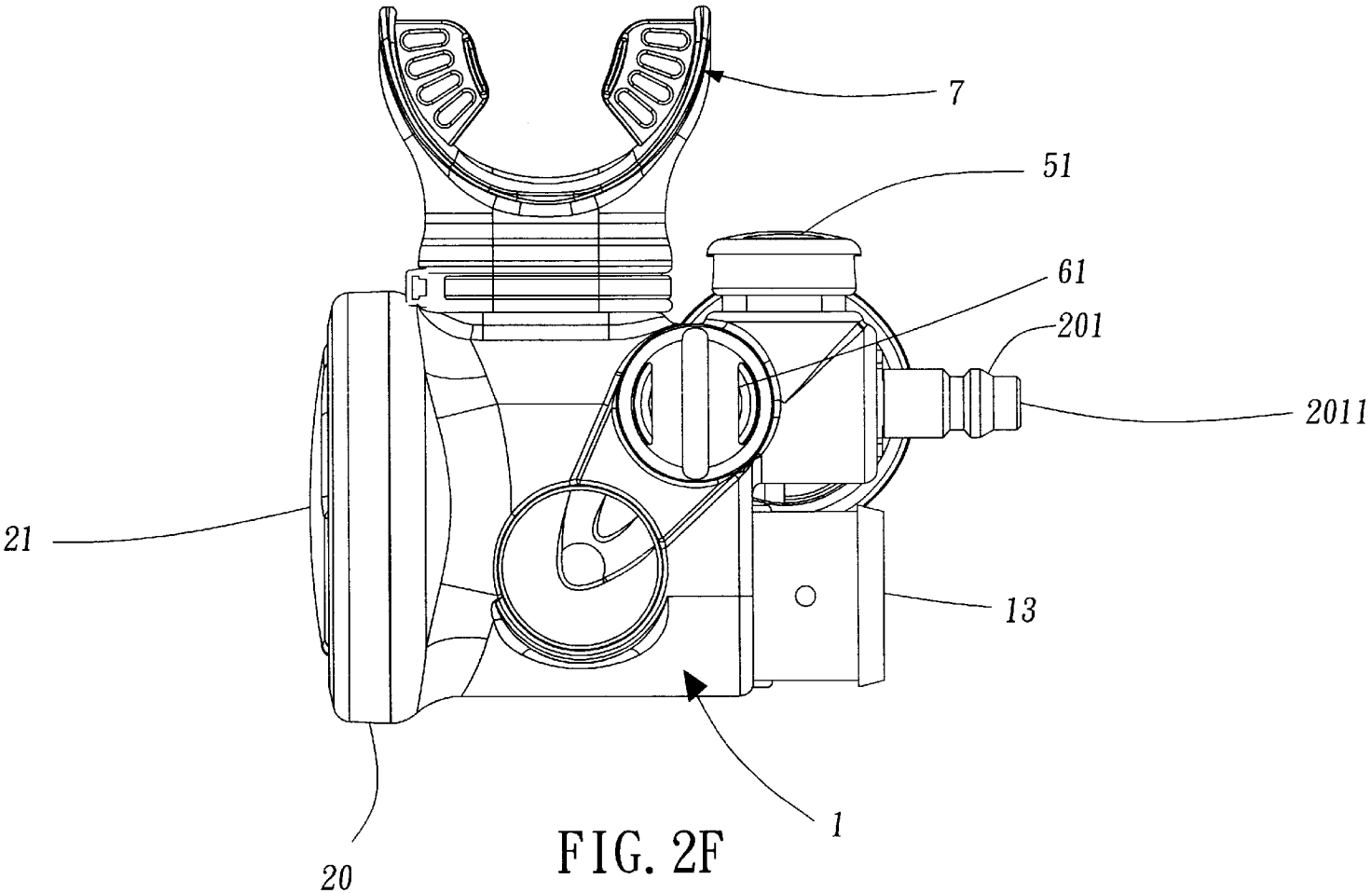
FIG. 2F is a frontal elevation view of a plane layout of the invention Triplicate Gas Valve Assembly.

Referring to FIG. 1, a three-dimensional exploded view of the invention Triplicate Diving Gas Valve Device concurrently with reference to FIG. 2A through FIG. 2F, plane view of the invention Triplicate Diving Gas Valve Device seen from various directional settings.

It will be readily appreciated that the invention Triplicate Diving Gas Valve Device may be used together with a Compression Cylinder (not shown in the illustrations), to serve any of triplicate functions, namely, release of alarming siren underwaters or on the surface, inflating a Life Coat, or Facilitating user's respiration, structurally, the triplicate Gas Valve Assembly comprises: a body 1, a flow bypass unit 2, a siren unit 4, a siren button 5, a charging button 6, an exhaust/blow switching unit 3(altogether the charging button 6 and the exhaust/blow switching unit 3 may be referred to as the inflation unit), and a Respiratory Mouthpiece 7, alias the Respiration Unit.

On the body 1 are provided a plurality of orifices, in this preferred, but non-limiting example they are known to be: a first orifice 11, a second orifice 12, a third orifice 13, a fourth orifice 14, a fifth orifice 15, a sixth orifice 16, a seventh orifice 17, an eighth orifice 18, and the ninth orifice 19, respectively. Each of these orifices being selectively communicable with the interiority of the body 1, thereby giving occasion to the formation of a plurality of mutually communicable or mutually isolated chargeable spaces.

On one side of the body 1 is provided a blocking film unit which seals in an air-tight manner the first orifice 11 of the body 1. The blocking film unit consists of: a diaphragm 22 covering up the first orifice 11, on the contour rim of the diaphragm 22 is attached a fastener 21 to hold in position exempt from gas leakage, and a first lock set 20 by which the diaphragm 22 is to be caught and locked to a first orifice 11 side on the body 1. To the third orifice 13 of the body 1 may be attached an air hose not shown in the illustrations, by which the Life Coat, not shown in the illustrations, is to be secured.

The bypass unit 2 is installed way between the first orifice 11 and the second orifice 12 of the body 1, limited in the body 1, there is also a Gas Valve sealed way between both orifice and as a follower of the diaphragm 22. The same bypass unit further comprises: an intake coupling 201 of which the interiority is occupied by an axially extending hollow-set gas conduit 2017; a hollow-set larger sleeving 214 locked to an interior rim of the intake coupling 201; a screw 211 mounted into the larger sleeving 214 and capable of executing linear glides within said larger sleeving 214; a minor sleeving 212 bound to one end 6f the screw 211 and symmetrical with respect to the binder 208; a first spring 213 mounted to the screw 211 to produce a resetting resilience whereby the minor sleeving 212 is pneumatically sealed to the binder 208 in the absence of any externally applied force, plus a rocker arm 216 of which one end is attached to the screw 211, and the other end in contact with said diaphragm 22.

The rocker arm 216 is united to the screw 211 by a nut 218 reinforced with a first washer 215 and a second washer 217. The screw 211 and the binder 208 is intervened by a first gasket 209 serving to reinforce the air-tight performance respecting the hollow-set binder 208 and a flat-head screw 210 serving to bring the minor sleeving 212 united to the screw 211. The intake coupling 201 has an intake port 2011 on one end projected beyond the second orifice 12 for intercoupling with the Compression Cylinder not shown in the drawings. On the outside surface of the intake coupling are furnished a plurality of grooves, including: the first groove 2012, the second groove 2013 and the third groove 2014, these being selectively and pneumatically isolated from each other by means of a number of O rings, including a fist O ring 202, a second O ring 2013, and a third O ring 2014. With the first air intake 205 and the second air intake 206 being respectively radially established into the first radial hole 2015 and the second radial hole 2016 across the intake coupling 201, selective coupling with the gas conduit 2017 inside the intake coupling 201 and the first groove 2012, the second and the third groove 2013, 2014 on the outside surface is achieved. Whereof the fist groove 2012 is associated with the third orifice 13, and the second, the third grooves 2013, 2014 associated respectively with the Siren Unit 3. The intake port 2011 about the intake coupling 201, to the extent that is projected beyond the second orifice 12, is snapped by a snap ring 23 to retain in the body 1.

The Respiratory Mouthpiece 7 is bound by a lacing 72 to the nineth orifice 19 on the body 1, and is associated with the internal space 24 of the diaphragm 22, such that, as the user inhales by way of the Respiratory Mouthpiece 7, the diaphragms 22 by reason of pressure imposed from its internal space will shrink up, and that in turn bringing pressure to bear upon the rocker arm 216, followed by the screw 211 and the minor sleeving 212 being pulled away from the binder 208 so that pneumatic seal no longer exists, what follows then is that the gas in the Compression Cylinder will thus flow into the internal space of the diaphragm 24 by way of the gas conduit 2017, eventually serving the user through the Respiratory Mouthpiece 7.

In a preferred example such as this one, there is in addition a diverting block 71 provided in the Respiratory Mouthpiece 7 positioned mindway in the Gas Conduit, serving to divert compressed gas flow oncoming from the source of supply, the Compression Cylinder, so that the flow is prevented from running all the way unrestrained into user's throat, so that the user will not feel ill at ease at all when respiring with the aid defined as such.

The Siren Unit 4 is installed in the sixth orifice 16 of the body 1, and further comprising: a hollow-set cylinder 45, a hollow-set piston 46 established by penetration across the cylinder 45, a pounding member 42 established on one end of the Gas Cylinder 45, and a flow guide shoe 43 clamped way between the gas cylinder 45 and the pounding member 42. The piston 46 is meant to move about reciprocatingly in the Gas Cylinder 45 so that the pounding member 42 once hit by the piston 46 in motion will release an alarming sound, siren to be specific, the hollow-set piston 46 is pneumatically associated with the second groove 2013 and the third groove 2014 on the outside surface of the intake coupling 201. On that side of the flow guide shoe 43 which faces the gas cylinder 45 are provided a plurality of axially extending gas conduit grooves 431, on the outer side of that end of the piston 46 that comes closer to the pounding member 42 there are provided axially running gas holes 461 which are communicable with the interior of the piston 46, on that end the gas cylinder 45 which comes closer to the pounding member 42 or thereabout are provided radially running gas holes 451 which are associated with that area way between the interior of the gas cylinder 45 and the outer surface of the piston 46. By virtue of a structure disclosed as such, what is sure to happen is that once the user presses the Siren Button 5 concurrent with the piston 46 being far flung from the pounding member 42, the head 462 of the piston 46 that is of a greater will, owing to the thrust from the compressed gas, somehow bring the piston 46 proper pushed toward the pounding member 42, when it turns that the piston 46 comes into contact with the pounding member42, the radial gas hole 461 on the piston 46 will be just aligned to the guide channel 431 of the flow guide shoe 43, while the head 462 of the piston 46 is just aligned to the radial gas hole 451 of the gas cylinder 45 and seals same pat, and that does mean something because the gas pressure within the piston 46 will by way of the guide channel 431 pass to the atmosphere, and the pressure will go down accordingly, it is to be noted further that at that juncture the pressure emergent as between the interior of the gas cylinder and the outer surface of the piston will be greater than the pressure prevalent on the head portion 462 of the piston, what follows in suit is that the piston 46 is pushed away from the pounding member 42, and that fact amounting to mean that piston 46, in that instance, being driven by the compressed air sourced from the compression cylinder, will automatically resort to repeated reciprocating movement concurrent with the release of alarming siren sounds.

Figure 3A:
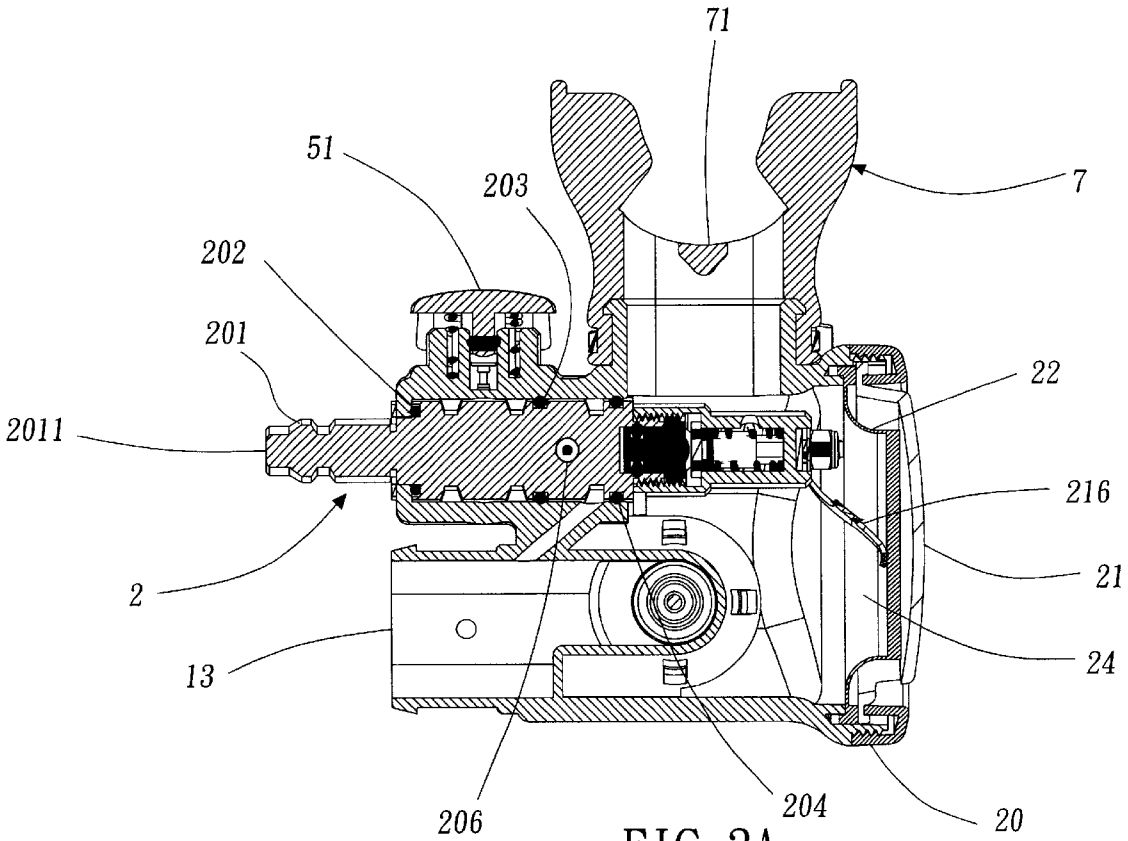
FIG. 3A is a section view of the invention Triplicate Diving Gas Valve Device taken along segment A—A.
Figure 3B:
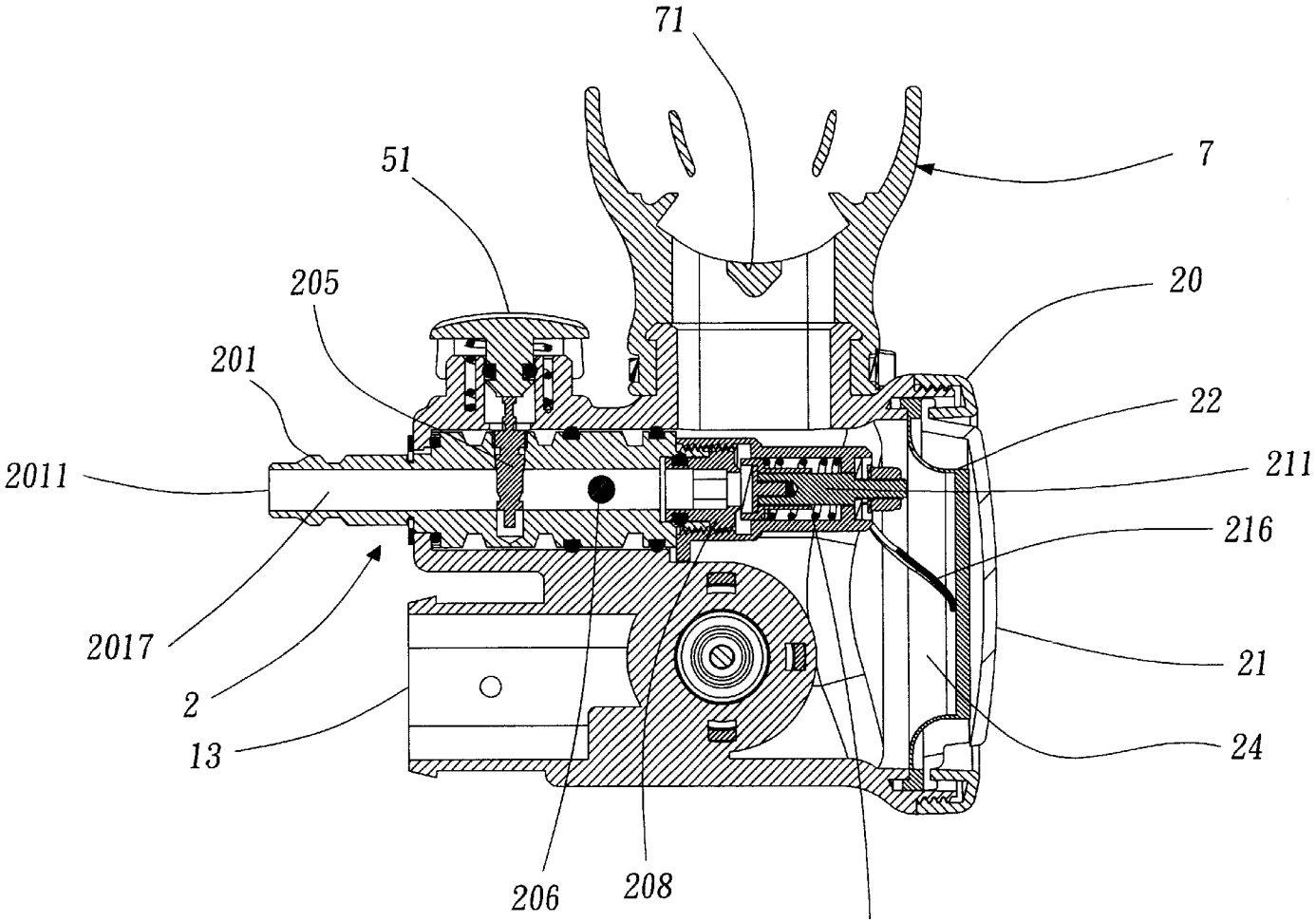
FIG. 3B is a section view of the invention Triplicate Gas Valve Assembly taken along segment B—B.
Figure 3C:
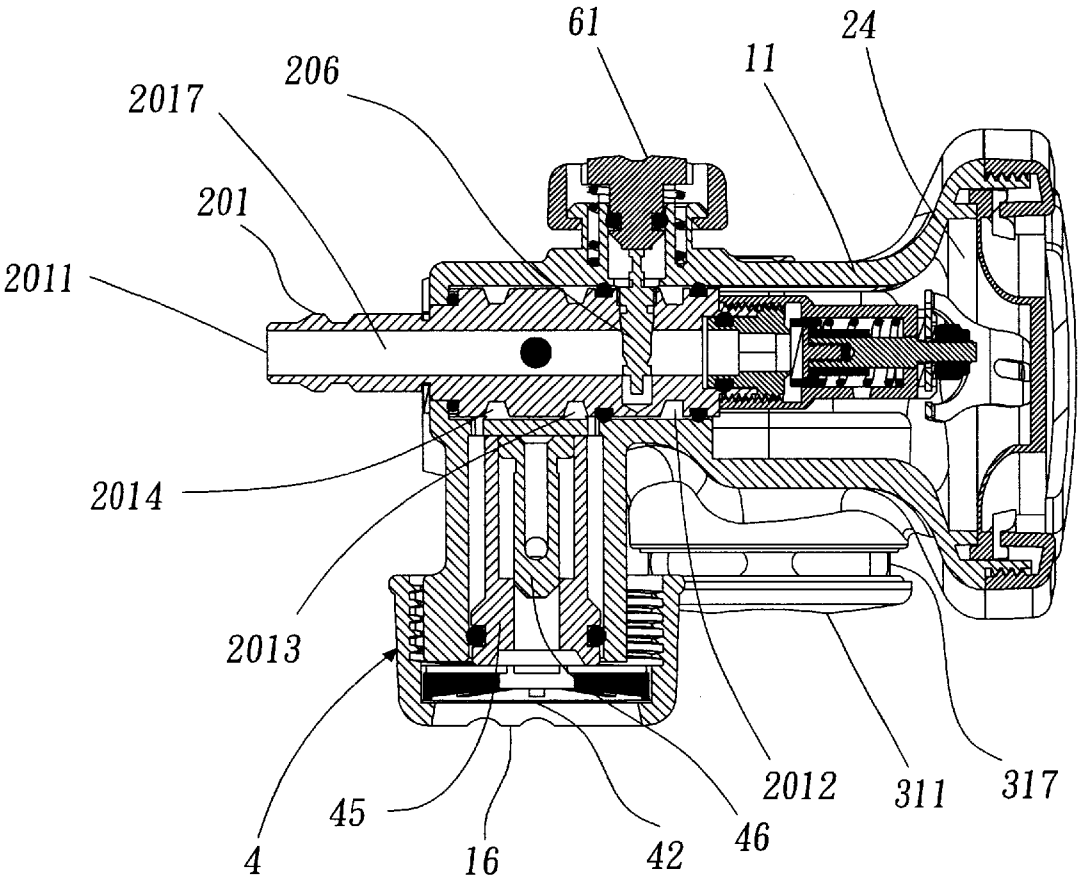
FIG. 3C is a. section view of the invention Triplicate Diving Gas Assembly taken along segment C—C.

With reference made to FIG. 1, FIG. 3B and FIG. 3C it will be appreciated that, the siren button 5 is established at the eighth orifice 18 of the body 1, and functionally in common with a first 205, on the siren button 5 there is also a fist pushbutton 51 serving the user, a tenth O ring 52, and a third spring 53 providing the resetting resilience for the first. pushbutton 51. When the siren button 5(the first pushbutton 51) is pressed, the first air intake 205 is driven open so that gas in the Compression Cylinder may flow by way of the Gas Conduit 2017 and the fist air intake 205 to second groove 2013, third groove 2014 on the outer surface of the intake coupling 201, before arriving at the siren unit 4 to transmit the piston 46 into repeated reciprocating movement in the Gas Cylinder 45, so that alarming siren is released as intended.

Referring now to FIG. 1, FIG. 3A and FIG. 3C altogether, it will be appreciated that the charging button 6 is established at the fourth orifice 14 of the body 1, functionally in common with the second air intake 206, on the charge button 6 are provided a second pushbutton 61 serving the user, an eleventh O Ring 62, and a fourth spring 63 providing resetting resilience to the second pushbutton 61. Once the charge button 6(the second pushbutton 61) is pressed, the second air intake 206 will be driven open whereby gas in the Compression Cylinder will flow by way of the Gas Conduit 2017 and the second air intake 206 to a first groove 2012 on the outer surface of air intake 201, before reaching the third orifice 13 where charging to inflate the Life Coat begins.

Figure 3E:
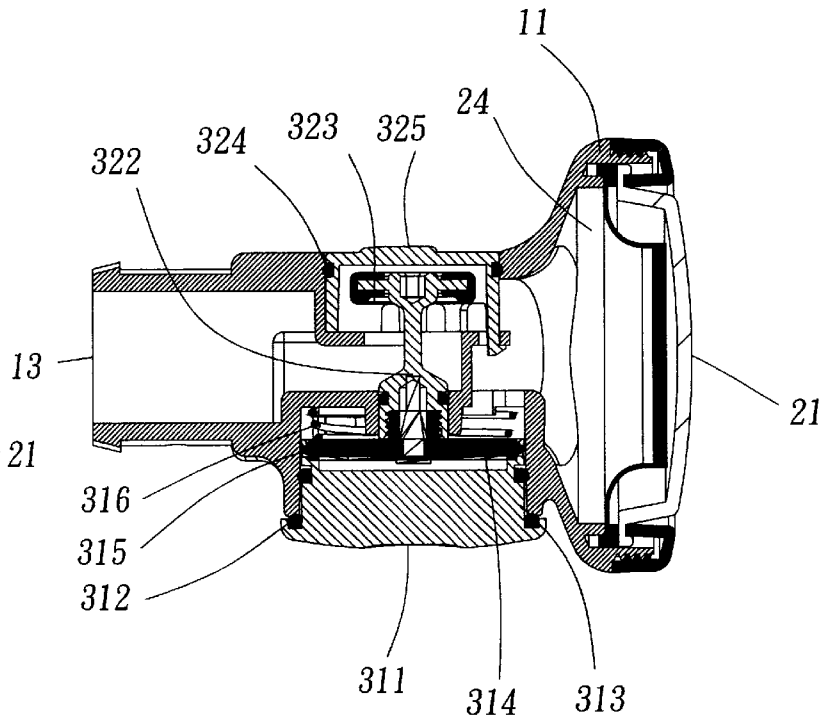
FIG. 3E is a section view of the invention Triplicate Diving Gas Valve, shown with the Blow Position prominent, along segment D—D.
Figure 3D:
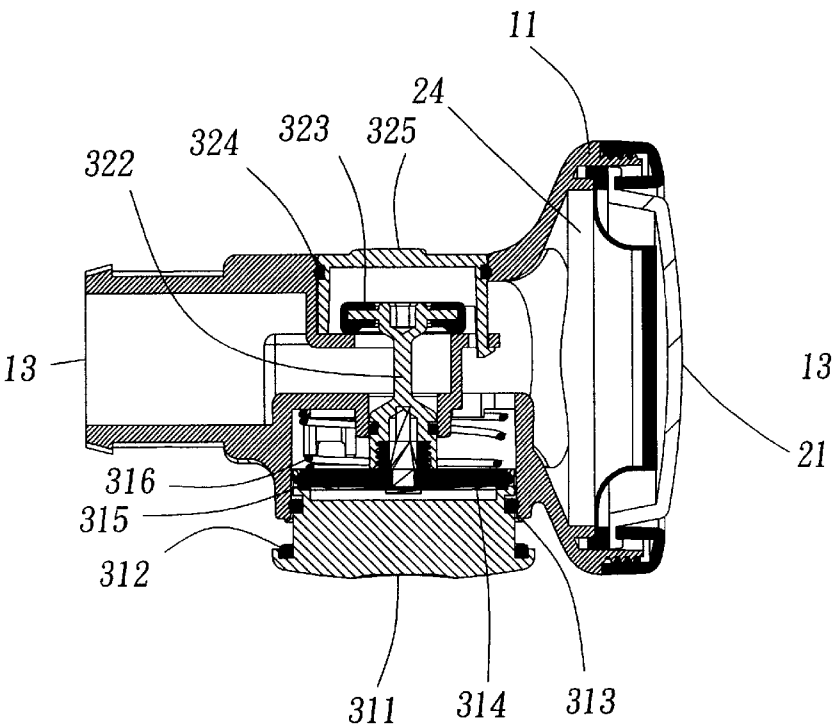
FIG. 3D is a section view of the invention Triplicate Diving Gas Valve, shown with the Discharge Position prominent, along segment D—D.

As shown in FIG. 1, FIG. 3D and FIG. 3E, the exhaust/blow switching unit 3 is installed by penetration way between the seventh orifice 17 and the fifth orifice 15 on the body 1 and is functionally in common with the space 24 inside the diaphragm 22, said exhaust/blow unit 3 further comprises: a check valve 31 and a switching means 32.

The check valve 31 is installed in the seventh orifice 17, and comprising: a current insulation 215 complete with a number of holes thereon, unassigned with reference numbers, a membrane 214 covering up one side of the current insulation ring 215 to form, in that sense, a check valve, a pushbutton 311 established in the seventh orifice 17 and containing said membrane 314 and current insulation ring 315, a second spring 316 installed in the seventh orifice 17 and bearing against the pushbutton 311 to provide a resetting resilience whereby the pushbutton 311 is compelled to project beyond the seventh orifice 17 in the absence of any externally applied force, plus a fifth O Ring 312 and a sixth O Ring 313 to provide the necessary air-tightness feature. On the lateral side of the pushbutton 311 are provided a number of holes 317 which are in communication with the atmosphere for as long as the pushbutton 311 remains projected outside of the seventh orifice 17, whereas once the pushbutton 311 is pressed into the seventh orifice 17, it is forthwith enclosed by the body 1.

The switching means 32 is established in the fifth orifice 15 and comprises: a follower 322 of which one end is united to and follows in step with the current insulation ring 315, in motion or at rest, a second gasket 323 coupled to the other end of the follower 322, a snap harness 325 which is pneumatically driven to seal the fifth orifice 15, and bring both the follower 322 and the second gasket 323 sealed within, plus a seventh O Ring 321 and an eighth O Ring 324 providing the necessary air-tightness effect.

For so long as the pushbutton 311 remains projected outside of the seventh orifice 17(as of the exhaust position per FIG. 3D), the second gasket 323 will remain hermetically covering up an interior hole (reference number absent) of the fifth orifice 15, whereby the third orifice 13 and the space 24 inside the diaphragm are both blocked from each other, that making it for the user to have exhaust by exhalation by way of the Respiratory Mouthpiece 7 discharged to the atmosphere via the hole 317 furnished on lateral surface of pushbutton 311, through the diaphragm interal space 26 and the check valve 31. Once the pushbutton 311 is pressed into the seventh orifice 17(the blow position as indicated in FIG. 3E), the second gasket 323 will then get rid of said interior hole; bringing the third orifice 13 into pneumatically communication with the space 26 within the diaphragm, so that exhalation, in the form of gas stream, by the user, by way of the Respiratory Mouthpiece 7, will find its way through the space 26 within the diaphragm, the third orifice 13, into the Life Coat and the inflation begin. Or alternatively, gas originally resident in the Life Coat will at that juncture be discharged to the atmosphere by way of the Respiratory Mouthpiece 7, and the Life Coat is deflated when so intended and the blowing is terminated.

In summation, the invention Triplicate Diving Gas Valve Device, in respect of which operation with one single hand will suffice, with which the procedure to apply when the user, that is, the diver is to proceed with normal respiration as a living soul, all that needs to be done is to turn the pushbutton 311 that is part of the exhaust/blow switching unit 3 to project outside of the seventh orifice 17(discharge setting), and it will make for the diver to breath the flow of compressed air coming from the Compression Cylinder, using the Respiratory Mouthpiece, the outlet for exhalation, by the same diver, is a hole 317 provided on the surface beside the pushbutton 311, leading to the atmosphere. When the user intends to serve himself of the alarm siren function, all that need to be done is to press the siren button 5 with one single hand, the tip of one finger, the index finer, for example, and compressed air resident in the Compression Cylinder will be conducted to the siren unit 4 which in turn will bring the piston 46 to reciprocating movements impinging upon the pounding member 42 so that alarming siren is produced as a vocal signal appealing for help, siren release in this instance will work and go resounding on the surface and underwaters to the same effect. Also, when the user intends to serve himself by inflating the Life Coat to full buoyancy compensation state, single hand operation will suffice still by pressing the charge button 6 using one finger tip, whereupon compressed air flow coming from the Compression Cylinder will be conveniently guided to the access point on the Life Coat and inflation of the Life Coat will begin automatically, and that in every sense easy and convenient enough. Or alternatively, the user may instead press the pushbutton 311 on the exhaust/blow switching unit 3 into the seventh orifice (oral blow setting), thereby bringing the Respiratory Mouthpiece 7 into communication with the Life Coat, that being made, the user may blow by way of the Respiratory Mouthpiece 7 his breath all the way into the Life Coat in a charge to inflation or else gas resident in the same Life Coat may be discharged to the atmosphere by way of Respiratory Mouthpiece 7 on release. More to mention, a flow direct means 71, in the form of a block, is incorporated into the Respiratory Mouthpiece 7, rightly forming an obstacle in the course of passage, whereby compressed air flow coming from the source of supply, the Compression Cylinder is diverted into both sides on the flank, thus prevented from plunging all the way into user's throat. So in short, the present invention can truly eliminate all defects and shortcomings inherent with all conventional or prior art, once for all.

What has disclosed thus far in the foregoing is but an account of certain preferred, non-limiting examples of the invention and it is to be noted that variation, variants, modifications made of and with respect to the invention in any manner whatsoever to the extent defined within the scope of the claims to be given herein shall nonethelss be deemed further implementation of the invention apparent to persons of mediocre competency who are professionals in the art.

What is claimed is:

1. A triplicate diving gas valve device for use with a compression cylinder for a three-in-one purpose of siren alarming, life coat inflation and facilitating a user's respiration, and comprising:

a body having a plurality of orifices, each being selectively linked within so that a plurality of interrelated, insulated, isolated spaces are formed within the body, on one side of the body is disposed a blocking diaphragm applied so as to cover up a first orifice, a first locking and fastening device coupled to said blocking diaphragm and secured to the first orifice side on the body, and a third orifice adapted to be connected to a life coat;

a shunting device housed in the body between the first orifice and a second orifice, which shunt device includes: an intake coupling of which an interior has a gas conduit extending axially, an internal end of the intake coupling is locked a hollow first sleeving by a hollow binder, into the first sleeving is seated a screw attached to a second sleeving, symmetrical with respect to the binder, and to a first spring having resetting resiliency sufficient to bring the second sleeving tight-sealed to said binder free of externally applied forces; a rocker arm having one elbow attached to the screw and another elbow in contact with said diaphragm; on one end of the intake coupling has an intake projecting outside the second orifice and adapted to be connected to a compression cylinder; on an outside surface of the intake coupling having first and second grooves isolated from each other by a plurality of o-rings in an air-tight manner; a first air intake and a second air intake located radially of the intake coupling, such that conduits inside the intake coupling may be selectively conducted to the first groove and the second groove with the first groove being connected to the third orifice;

a siren unit, mounted in a sixth orifice of the body, which unit includes: a hollow cylinder, a hollow piston penetrating across the cylinder and a pounding member installed on one end of the cylinder, the piston reciprocating in the cylinder so that the pounding member is impinged by the piston to generate an alarming siren, the hollow piston pneumatically communicating with the second groove on the intake coupling;

a respiratory mouthpiece, coupled to a ninth orifice on the body, and in communication with space inside said diaphragm, such that as a user diver inhales, the diaphragm will shrink due to a pressure drop in the space within, which in turn controls the rocker arm to pull both the screw and the second sleeving apart from the binder so that a hermetic sealing condition broken, enabling air to flow into a space inside the diaphragm by way of a conduit, and be fed to the diver;

a siren button, on an eighth orifice on the body, in common transmission with said first air intake, such that the first air intake will be driven open when the siren button is pressed, whereupon gas will flow to the second groove and into the siren unit so that the piston is driven to reciprocating movement; and, a charge button, on a fourth orifice of the body in common with the second air intake, such that, when pressed, the second air intake will open so that gas flows to the first groove on the surface outside the intake coupling by way of the second air intake and the third orifice.

2. The triplicate diving gas valve device according to claim 1, further comprising a discharge/blow switching unit between a seventh orifice of the body, and being in association with the space inside said diaphragm, said unit further incorporating:

a check valve, in said seventh orifice which further incorporates: a flow insulation ring having a plurality of first holes provided thereon, a film covering one side of the flow insulation ring to form a check valve, a pushbutton mounted in the flow insulation ring, a second spring mounted in the seventh orifice, and bearing against the pushbutton so as to produce a resetting resilience whereby the pushbutton is compelled to project out of the seventh orifice in the absence of any applied force, on a surface of the side of the pushbutton are provided a plurality of second holes accessible to the atmosphere so long as the pushbutton remains projected out of the seventh orifice, but are sealed by the body once the pushbutton moves into the seventh orifice; and a switching device in the fifth orifice and comprising: a follower of which one end is linked to and coacts with said flow insulation ring, a second hermetic cork which is attached to another end of the follower, and a fastening harness which is concealed under the fifth orifice and houses both the follower and the second hermetic cork;

such that when the pushbutton remains projected out of the seventh orifice, the second hermetic cork covers an interior hole inside the fifth orifice, whereupon the third orifice remains in a non-communication state with the space inside the diaphragm, so that exhalation form the diver user by way of the mouthpiece issues to the atmosphere; and, once the pushbutton is pressed into the seventh orifice, the second hermetic sealing cork uncovers said interior hole bring the third orifice in communication with the space inside the diaphragm, so that exhalation from the user diver by way of the respiratory mouthpiece may proceed by way of the space inside the diaphragm and the third orifice.

3. The triplicate diving gas valve device according to claim 1, wherein said respiratory mouthpiece further comprises a shunt block positioned as an obstruction in the way of gas flow course whereby compressed air flow is shunted to bypass bilaterally, and in that manner prevented from charging straight, unimpeded, into user's throat.

4. The triplicate diving gas valve device according to claim 1, wherein the siren unit further comprises current guide shoe having a plurality of conduit grooves, and a surface of the piston that is closest to the pounding member are located radial gas holes;

such that once the user presses the siren button while the piston is distant from the pounding member, the piston is pushed into contact with the pounding member, the axial gas hole of the piston is aligned with the conduit groove of the current guide shoe, and the piston abuts upon and therefore seals the axial gas hole such that gas is directed via the gas conduit groove to the atmosphere, and pressure is downgraded, whereupon the pressure on an external surface of the piston will exceed pressure prevalent about a head portion of the piston, such that the piston is thrusted off the pounding member, placing the piston in recycled reciprocating movement.

* * * * *